US006948403B2

(12) United States Patent
Singh

(10) Patent No.: US 6,948,403 B2
(45) Date of Patent: Sep. 27, 2005

(54) BOWED CRESTS FOR MILLED TOOTH BITS

(75) Inventor: Amardeep Singh, Houston, TX (US)

(73) Assignee: Smith International, Houston, TX (US)

( * ) Notice: Subject to any disclaimer, the term of this patent is extended or adjusted under 35 U.S.C. 154(b) by 23 days.

(21) Appl. No.: 10/625,985

(22) Filed: Jul. 24, 2003

(65) Prior Publication Data

US 2005/0087369 A1 Apr. 28, 2005

Related U.S. Application Data

(62) Division of application No. 09/931,517, filed on Aug. 16, 2001, now Pat. No. 6,725,952.

(51) Int. Cl.[7] ..... B21K 5/02
(52) U.S. Cl. ..... 76/108.2; 175/425
(58) Field of Search ..... 76/108.2, 108.1; 175/374, 378, 341, 375, 425

(56) References Cited

U.S. PATENT DOCUMENTS 3,003,370 A * 10/1961 Coulter, Jr. ..... 148/211
3,223,188 A * 12/1965 Coulter, Jr. et al. ..... 175/341

FOREIGN PATENT DOCUMENTS

CA 2305831 4/2000 ..... E21B 10/16

* cited by examiner

*Primary Examiner*—Douglas D Watts
(74) *Attorney, Agent, or Firm*—Osha Liang L.L.P.

(57) ABSTRACT

A method of forming milled teeth on a roller cone of a milled tooth roller cone rock bit includes shaping a crest of a chisel shaped milled tooth on the roller cone. The crest is shaped such that the crest has a convex profile from one corner to an opposite corner of the crest. Such a crest is adapted to produce at least one of a convex axial stress distribution, a substantially even axial stress distribution, and a substantially smooth axial stress distribution. Further, the forming includes radiusing each of the corners at the ends of the crest of the chisel shaped milled tooth.

18 Claims, 14 Drawing Sheets

BOWED CRESTS FOR MILLED TOOTH BITS

CROSS-REFERENCE TO RELATED APPLICATIONS

This application is a divisional application of U.S. patent application Ser. No. 09/931,517, entitled "BOWED CREST FOR MILLED TOOTH BITS," filed Aug. 16, 2001, inventor Amardeep Singh, and herein incorporated by reference.

STATEMENT REGARDING FEDERALLY SPONSORED RESEARCH OR DEVELOPMENT

Not applicable.

BACKGROUND OF INVENTION

1. Field of the Invention

The invention relates generally to earth-boring bits used to drill a borehole for the ultimate recovery of oil, gas or minerals. More particularly, the invention relates to roller cone rock bits and to an improved cutting structure for such bits. Still more particularly, the invention relates to a cutter element having a bowed crest geometry which provides for a more uniform stress distribution.

2. Background Art

The success of rotary drilling enabled the discovery of deep oil and gas reserves. The roller cone rock bit was an important invention that made that success possible. The original roller-cone rock bit, invented by Howard R. Hughes, U.S. Pat. No. 930,759, was able to drill the hard caprock at the Spindletop field, near Beaumont, Tex.

That invention, within the first decade of the twentieth century, could drill a scant fraction of the depth and speed of modern rotary rock bits. If the original Hughes bit drilled for hours, the modern bit drills for days. Bits today often drill overall improvement in the performance of rock bits.

Roller-cone rock bits typically are secured to a drill string, which is rotated from the surface. Drilling fluid or mud is pumped down the hollow drill string and out of the bit. The drilling mud cools and lubricates the bit as it rotates and carries cuttings generated by the bit to the surface.

Roller-cone rock bits generally have at least one, and typically three roller cones rotatably mounted to a bearing on the bit body. The roller cones have cutters or cutting elements on them to induce high contact stresses in the formation being drilled as the cutters roll over the bottom of the borehole during drilling operation. These stresses cause the rock to fail, resulting in disintegration and penetration of the formation material being drilled.

Operating in the harsh down hole environment, the components of roller-cone rock bits are subjected to many forms of wear. Among the most common forms of wear is abrasive wear caused by contact with abrasive rock formation materials. Moreover, the drilling mud, laden with rock chips or cuttings, is a very effective abrasive slurry.

Many wear-resistant treatments are applied to the various components of the roller-cone rock bit. Among the most prevalent is the application of a welded-on wear-resistant material or "hardfacing." This material can be applied to many surfaces of the rock bit, including the cutting elements.

U.S. Pat. No. 4,262,761 discloses a milled steel tooth rotary rock bit wherein one or more holes are drilled into the crest of the tooth-shaped cutting structure. Tungsten carbide rods are positioned in the holes and hardfacing is applied to the tooth. The hardfacing is applied across the top of the tooth crest and acts to hold the tungsten carbide rods in place. The rods are inserted in holes parallel and close to one flank of the tooth so that the entire length of the carbide rods can be attached to the hardfacing by burning the hardfacing through to the carbide rods. Wear on the tooth will proceed along the side of the tooth not reinforced with the carbide rods and a self-sharpening effect is enhanced by the strength of the carbide rods. The carbide rods and holes therefore can be relatively inexpensive, since close tolerance finishing is not required.

U.S. Pat. No. 5,152,194 discloses a milled tooth roller cone rock bit consisting of chisel crested milled teeth with generously radiused corners at the ends of the crest. A concave depression is formed in the crest between the radiused ends. A layer of hardfacing material formed over each tooth is thicker at the corners and in the concave depressions in the crest to provide a means to inhibit wear of the hardfacing as the bit works in a borehole.

U.S. Pat. No. 5,311,958 discloses an earth-boring bit that is provided with three cutters, two of the three cutters are provided with heel disk cutting elements defined by a pair of generally oppositely facing disk surfaces that generally continuously converge to define a circumferential heel disk crest. One of the two cutters having heel disk elements is further provided with an inner disk cutting element.

U.S. Pat. No. 5,492,186 discloses an earth boring bit rotatable cutter having a first hardfacing composition of carbide particles selected from the class of cast and macrocrystalline tungsten carbide dispersed in a steel matrix deposited on the gage surface of at least some of the heel row teeth. A substantial portion of these particles are characterized by a high level of abrasion resistance and a lower level of fracture resistance. A second hardfacing composition of carbide particles selected from the class of spherical sintered and spherical cast tungsten is dispersed in a steel matrix deposited over at least the crest and an upper portion of the gage surface to cover the corner that tends to round during drilling. A substantial portion of the particles of this composition are characterized by a high level of fracture resistance and a lower level of abrasion resistance.

U.S. Pat. No. 5,868,213 discloses a steel tooth, particularly suited for use in a rolling cone bit, includes a root region, a cutting tip spaced from the root region and a gage facing surface therebetween. The gage facing surface includes a knee, and is configured such that the cutting tip is maintained at a position off the gage curve. So positioned, the cutting tip is freed from having to perform any substantial cutting duty in the corner on the borehole corner, and instead may be configured and optimized for bottom hole cutting duty. The knee on the gage facing surface is configured and positioned so as to serve primarily to cut the borehole wall. It is preferred that the knee be positioned off gage, but that it be closer to the gage curve than the cutting tip.

U.S. Pat. No. 6,206,115 discloses an earth-boring bit having a bit body with at least one earth disintegrating cutter mounted on it. The cutter is generally conically shaped and rotatably secured to the body. The cutter has a plurality of teeth formed on it. The teeth have underlying stubs of steel which are integrally formed with and protrude from the cutter. The stubs have flanks which incline toward each other and terminate in a top. A carburized layer is formed on the flanks and the top to a selected depth. The stub has a width across its top from one flank to the other that is less than twice the depth of the carburized layer. A layer of hardfacing is coated on the tops and flanks of the stub, forming an apex for the tooth.

U.S. Pat. No. 6,241,034 discloses a cutter element for a drill bit. The cutter element has a base portion and an extending portion and the extending portion has either a zero draft or a negative draft with respect to the base portion. The non-positive draft allows more of the borehole bottom to be scraped using fewer cutter elements. The cutter elements having non-positive draft can be either tungsten carbide inserts or steel teeth.

Referring now to FIG. 1, which illustrates a milled tooth roller cone rock bit generally designated as 10. The bit 10 consists of bit body 12 threaded at pin end 14 and cutting end generally designated as 16. Each leg 13 supports a rotary cone 18 rotatively retained on a journal, optionally cantilevered from each of the legs (not shown). The milled teeth generally designated as 20 extending from each of the cones 18 may be milled from steel. Each of the chisel crested teeth 20 forms a crest 24, a base 22, two flanks 27, and tooth ends 29.

Hardfacing material may be applied to at least one or each of the teeth 20. In one embodiment, the application of hardfacing is applied only to the cutting side of the tooth as opposed to the other flanks 27 and ends 29 of the teeth 20. In another embodiment, the hardfacing may be applied to all the flanks 27 and ends 29 of the teeth 20.

The rock bit 10 may further include a fluid passage through pin 14 that communicates with a plenum chamber (not shown). In one embodiment, there are one or more nozzles 15 that are secured within body 12. The nozzles direct fluid from plenum chamber (not shown) towards a borehole bottom. In another embodiment, the rock bit 10 has no nozzles 15. In another embodiment, the upper portion of each of the legs may have a lubricant reservoir 19 to supply a lubricant to each of the rotary cones 18 through a lubrication channel (not shown).

Turning now to the prior art of FIGS. 2A and 2B, conventional hardfaced chisel crested teeth generally designated as 40, when they operate in a borehole for a period of time, wear on the corners 44 of the teeth. The prior art tooth consists of a crown or crest 41 having hardfacing material 42 across the crest and down the flanks 43 terminating near the base 45 of the tooth 40.

FIG. 2C shows the prior art tooth of FIG. 2A with a typical axial stress distribution. The prior art teeth (40) typically have a concave axial stress distribution (50) as shown in FIG. 2C.

As heretofore stated the hardfacing material 42 transitioning from the crest 41 towards to the flanks 43 may be very thin at the corners of the conventional teeth 40. Consequently, as the tooth wears, the hardfacing, since it may be very thin, may wear out quickly, and thus expose the underlying steel 47 of the tooth 40. Consequently, erosion voids (not shown) could invade the base metal 47 since it is usually softer than hardfacing material 42.

SUMMARY OF INVENTION

According to one aspect of one or more embodiments of the present invention, a method of forming milled teeth on a roller cone of a milled tooth roller cone rock bit comprises: shaping a crest of at least one chisel shaped milled tooth such that the crest comprises at least one convex profile from one corner to an opposite corner of the crest, where the convex crest is adapted to produce at least one of a convex axial stress distribution, a substantially even axial stress distribution, and a substantially smooth axial stress distribution; and radiusing each of the corners at the ends of the crest of the at least one chisel shaped milled tooth.

DETAILED DESCRIPTION

Figure 3:
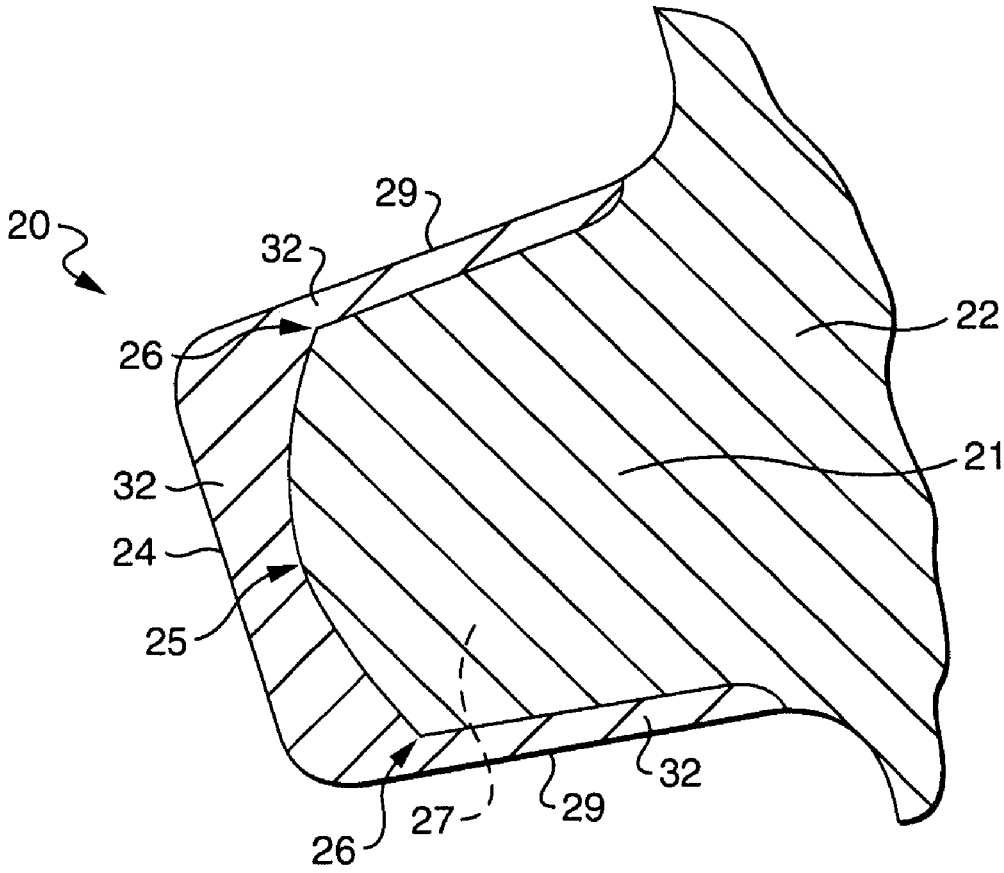
FIG. 3 is a cross-sectional view of an improved hardfaced chisel crested milled tooth.

Turning now to one embodiment illustrated in FIG. 3, the chisel tooth generally designated as 20 consists of, for example, a steel foundation 21, forming flanks 27, ends 29 and a crest 24. Between rounded corners 26 is a convex portion 25 on the crest 24 of the tooth. The convex portion 25 enables hardfacing material 32 to be thicker at the corners 26 of the crest 24, therefore providing for more durable cutting corners 26. Each of the corners 26 has a sufficient radius so that the thickness of the hardfacing material is assured as it transitions from the crest 24 towards the ends 29 and the flanks 27 of the tooth 20. The hardfacing material may terminate at the base 22 of each of the teeth 20. The base 22 provides a termination point for the hardfacing material 32 as it is applied over the crest ends and flanks of each of the teeth 20.

By providing a convex portion 25 or rounded geometry and rounded corners 26 at the end of the crested tooth, the hardfacing material may be applied more generously at the corners 26 of the crest and at a sufficient thickness in the center of the crest to produce a generally flat crest 24. The geometry at the corners 26 assures a thick application of hardfacing material at a vulnerable area of the tooth.

One suitable hardfacing material and a method of its application is described in U.S. Pat. No. 4,836,307 to Keshavan et al and is incorporated herein by reference in its entirety.

Figure 4:
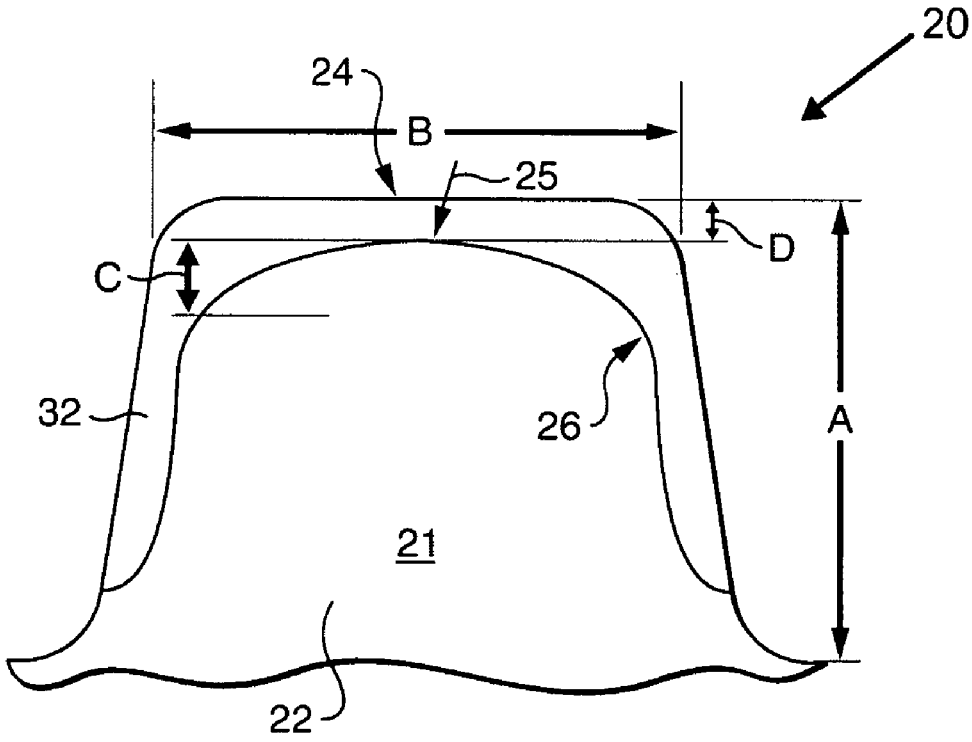
FIG. 4 is a diagrammatic cross-section of a tooth of a 9⅞ inch milled tooth rotary cone rock bit.

Referring now to the cross-sectional example of FIG. 4, a typical tooth 20 formed from a cone of a 9⅞ inch diameter milled tooth roller cone rock bit could, for example, have a tooth height "A" of about 0.5 to about 1.5 inches, in one embodiment, 0.72 inches, and a width "B" of about 0.5 to about 1.0 inches, in one embodiment, 0.62 inches across the chisel crown of the tooth 20. The radius at the corners 26 may be between about 0.02 and about 0.20 inches, in one embodiment, about 0.08 inches. The convex radius 25 may be between about 0.15 and 1.0 inches, in one embodiment, 0.50 inches. The depth "C" of the convex radius may be between about 0.02 inches and about 0.20 inches, in one embodiment, about 0.05 inches.

In one embodiment, the crest 24 of the tooth 20 may be substantially flat between radiused corners, the tooth having a varied hardfacing 32 thickness between radiused corners. In another embodiment, the crest 24 of the tooth 20 may be convex between radiused corners, the tooth having a constant hardfacing thickness between radiused corners. In another embodiment, the crest 24 of the tooth 20 may be convex between radiused corners, the tooth having a varied hardfacing 32 thickness between radiused corners, wherein the hardfacing 32 is thicker at the radiused corners.

The hardfacing 32 may have a thickness along the ends 29, flanks 27 and corners 26 between about 0.02 and about 0.18 inches, in one embodiment a thickness of about 0.10 inches.

The thickness of the hardfacing at depth "D" and along the crest 24 may be between about 0.04 and about 0.18 inches, in one embodiment a depth of about 0.10 inches (with respect to the example of FIG. 3).

Figure 5:
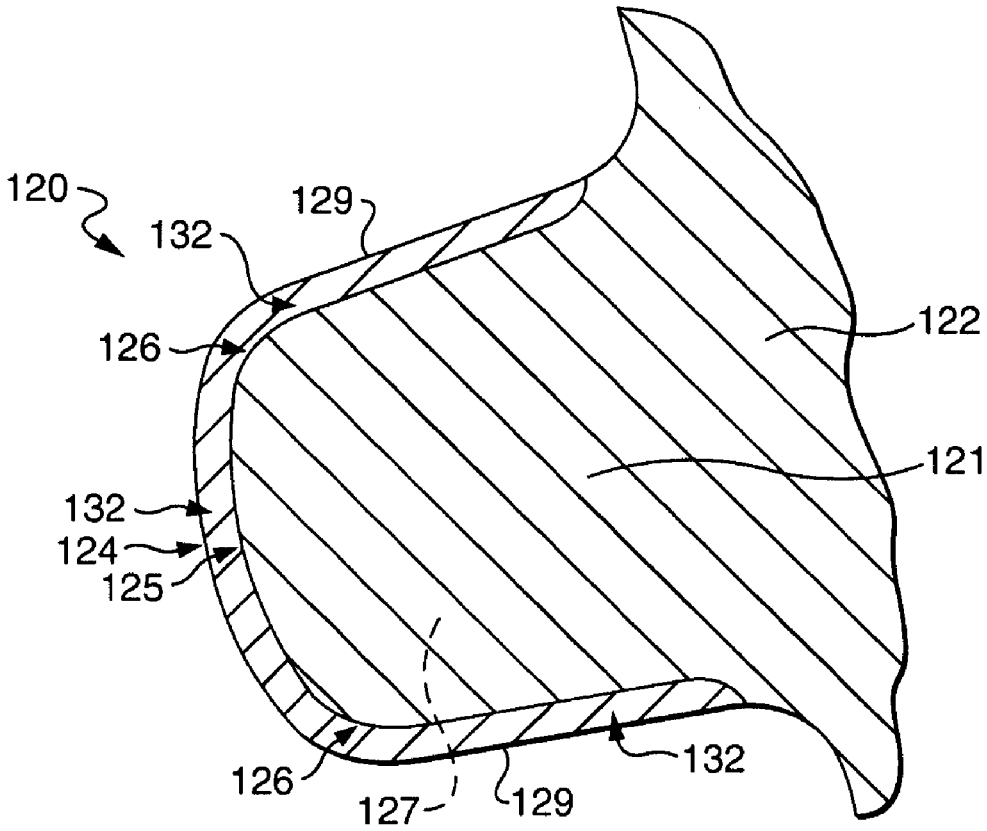
FIG. 5 is a cross-sectional view of another configuration of an improved hardfaced milled tooth.

FIG. 5 illustrates an alternative embodiment of the present invention wherein the chisel crest tooth generally designated as 120 forms a crest 124 that transitions into ends 129 and flanks 127. Crest 124 forms a convex shape 125, in one embodiment a bow, between corners 126 that allows a substantially uniform thickness of hardfacing material 132 across the crest 124. The hardfacing material 132 can also maintain a relatively thick layer across the corners 126 and down the ends 129 and flanks 127 towards the cone 18 (shown in FIG. 1). One advantage may be to maintain a uniform axial stress profile across the crest 124. Another advantage may be to provide a robust or thick hardfacing material across the flanks 124 and ends 126 such that the tooth as it operates in a borehole retains its integrity and sharpness as it works in a borehole.

In another embodiment of the present invention (not shown), the chisel crest tooth, generally designated as 120 forms a crest 124 that transitions into ends 129 and flanks 127. Crest 124 forms a convex shape 125, in one embodiment a bow, between corners 126 that allows a gradually decreasing thickness of hardfacing material 132 across the crest 124, so that the thickness of the hardfacing material 132 is thickest across the corners and less thick in the middle between the corners. The hardfacing material 132 can also maintain a relatively thick layer across the corners 126 and down the ends 129 and flanks 127 towards the cone 18 (shown in FIG. 1). One advantage may be to maintain a uniform axial stress profile across the crest 124, or a convex stress profile across the crest 124. Another advantage may be to provide a robust or thick hardfacing material across the flanks 124 and ends 126 such that the tooth as it operates in a borehole retains its integrity and sharpness as it works in a borehole.

In another alternative embodiment, the flanks 127 and/or the ends 129 may have a depression or concave portion (not shown) whereby the hardfacing material is thicker at the concave portion thus providing a thicker area along the flanks 127 and/or the ends 129. In another alternative embodiment, the flanks 127 and/or the ends 129 may have a convex portion (not shown) or a bow, whereby the hardfacing material is either the same thickness or thinner at the convex portion (not shown). Hardfacing may terminate at base 122 at each of the mill teeth 120. A convex portion on the flanks 127 and/or the ends 129 may provide increased tooth strength due to the larger amount of tooth substrate material. A concave portion on the flanks 127 and/or the ends 129 may provide increased hardfacing thickness and increased tooth durability due to the larger amount of tooth hardfacing material.

In another alternative embodiment, the tooth may have more than one convex portions, or bows, along the crest, the corners may be rounded in much the same manner as in FIGS. 3, 4, and 5 in order to assure a thickness at the corners of the tooth. In another alternative embodiment, the flanks and/or the ends may have a concave portion, a convex portion, or multiple concave and/or convex portions. Alternatively, the flanks and/or the ends may have a series of depressions to assure a robust layer of hardfacing along the ends and flanks. The hardfacing material may terminate on a groove or shoulder or recess at the base of the tooth.

Figure 6:
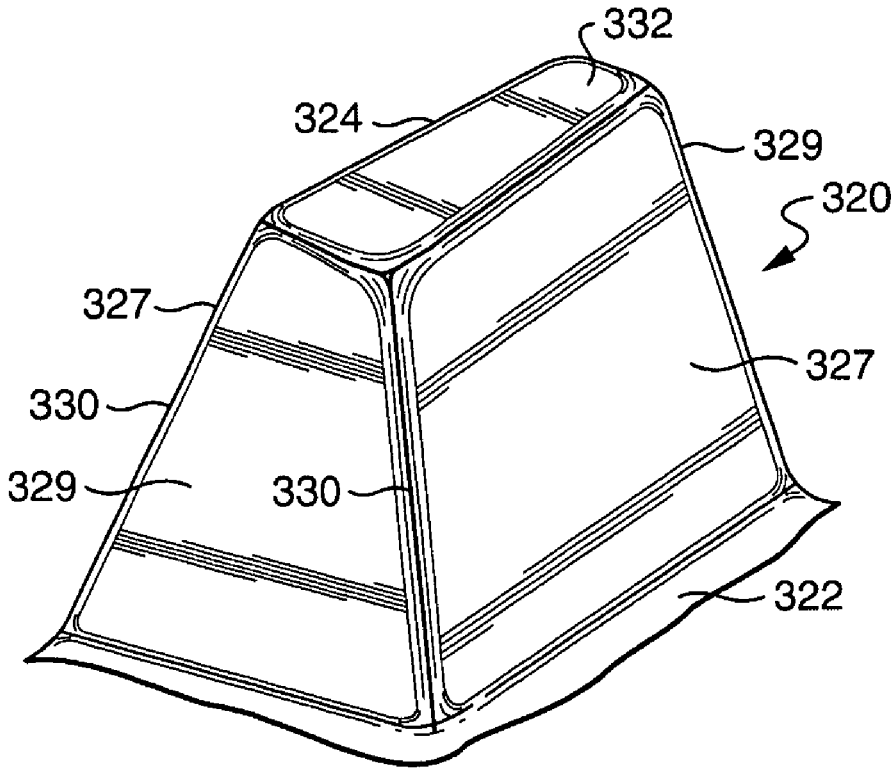
FIG. 6 is a perspective view of a single chisel crested milled tooth with hardfacing in a thicker layer around rounded corners of the tooth adjacent the flank and end faces of the tooth.

FIG. 6 illustrates a perspective view of one of the chisel crested teeth 320 wherein the corners 330 of the tooth are rounded, so that a minimum thickness of hardfacing material 332 is on the corner 330, which forms the junctions between the ends 329 and flanks 327. The steel foundation (not shown) is covered by the hardfacing material 332. The top of the tooth 320 forms a crest 324. In one embodiment, the crest 324 is convex, and in an alternative embodiment, the crest 324 is substantially flat. The hardfacing material 332 terminates at the base 322 of the tooth 320. The base 322 provides a termination point for the hardfacing material 332 as it is applied over the crest ends 329 and flanks 327 of each of the teeth 320. The hardfacing material 332 is applied with a sufficient thickness over the entire tooth to improve its integrity and durability.

In an alternative embodiment, a milled tooth with a convex chisel crest converging at both radiused ends could be hardfaced. In one embodiment, the thickness of the hardfacing could remain substantially constant across the crest as illustrated by the specific example of FIG. 5. In another embodiment, the thickness of the hardfacing could vary across the crest as illustrated by the specific example of FIG. 3.

In an alternative embodiment, a spherical or semi-spherical surface of a milled tooth could be hardfaced as long as the radiuses are within the general parameters set forth in FIG. 4, thereby assuring a minimum thickness of hardfacing and the enhanced durability of the tooth as it works in a borehole.

In an embodiment such as shown in FIG. 6, each tooth 320, after the hardfacing 332 is applied, will appear outwardly with relatively straight crest 324, ends 329, and flanks 327, the hardfacing having a uniform termination point at the base 322 of the milled tooth 320. In another embodiment, one or more of the crest 324, ends 329, and flanks 327 may have a rounded appearance.

Figure 1:
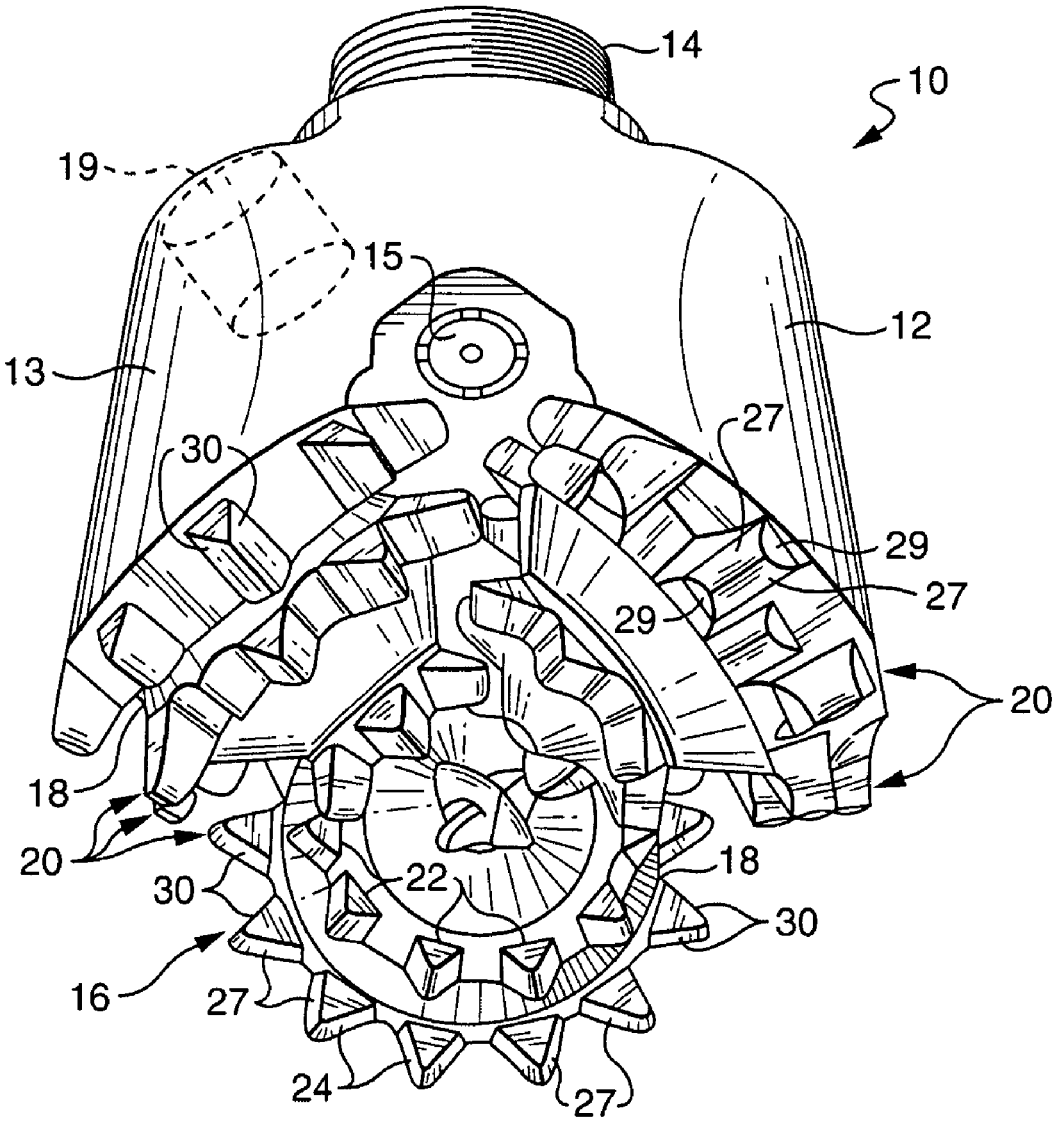
FIG. 1 is a perspective view of a milled tooth rotary cone rock bit with hardfacing material on each tooth.
Figure 2A:
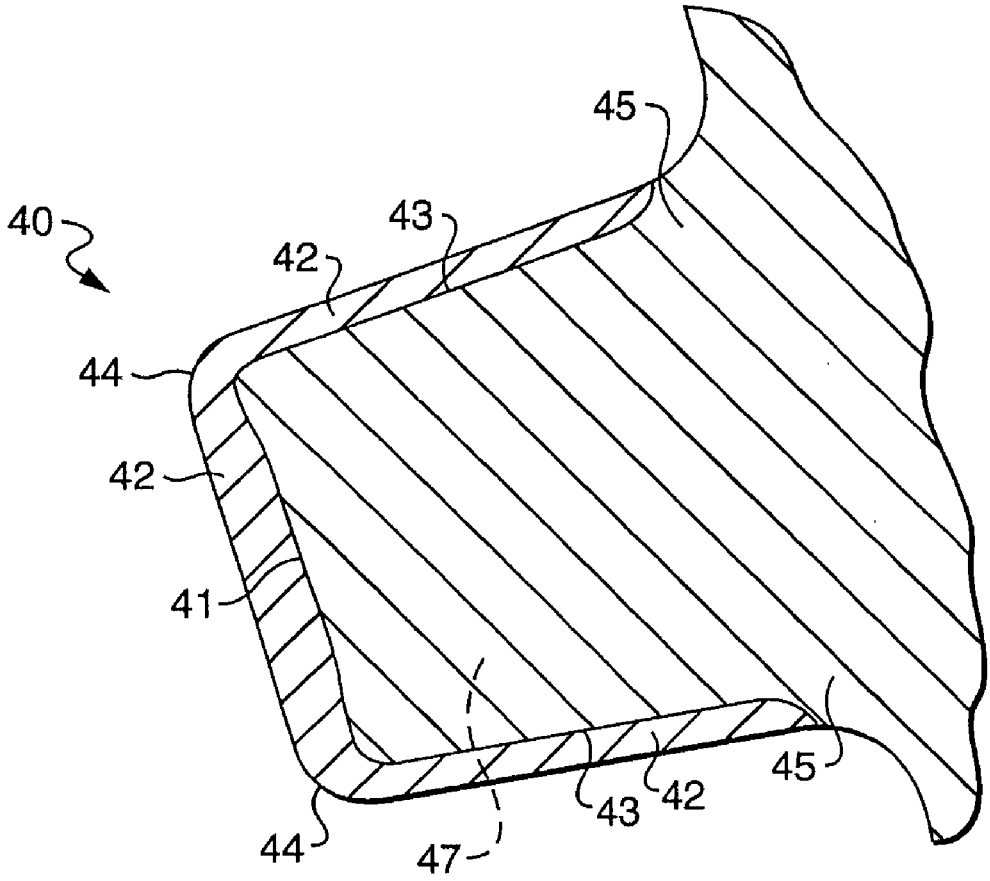
FIG. 2A (Prior Art)
FIG. 2A is a cross-sectional prior art view of a tooth illustrating the crest and hardfacing of the tooth.
Figure 2B:
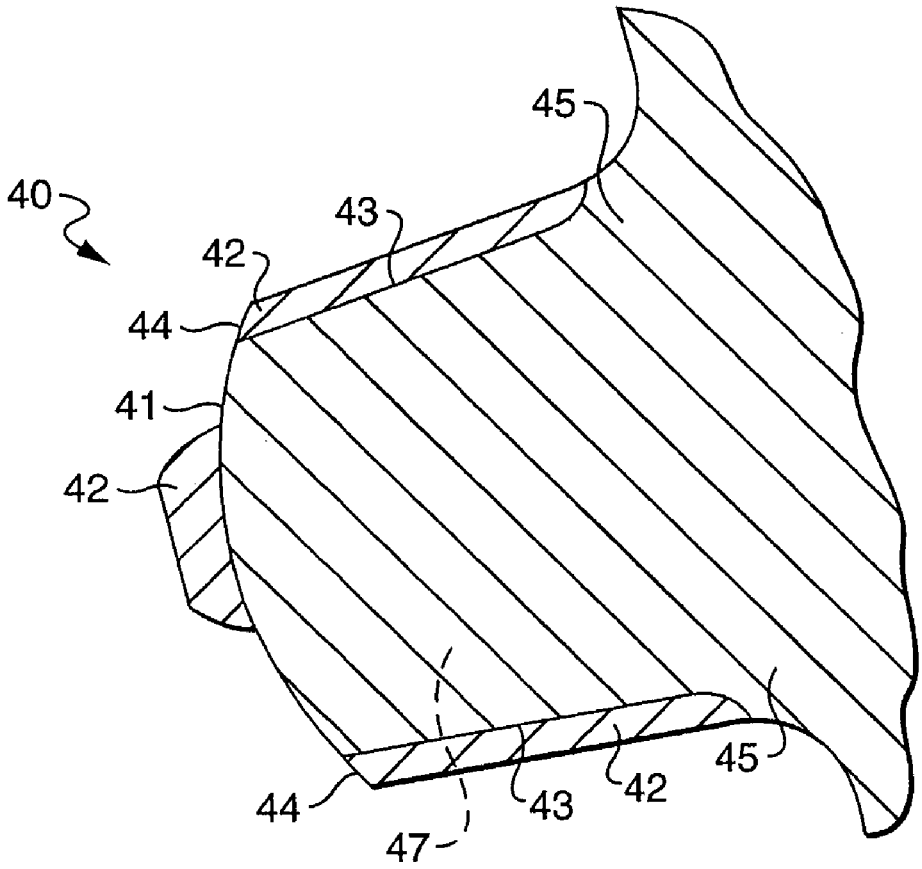
FIG. 2B (Prior Art)
FIG. 2B is a cross-sectional prior art view of a worn tooth illustrating destructive voids in the hardfacing and base metal material at the corners of the crest of the tooth.
Figure 2C:
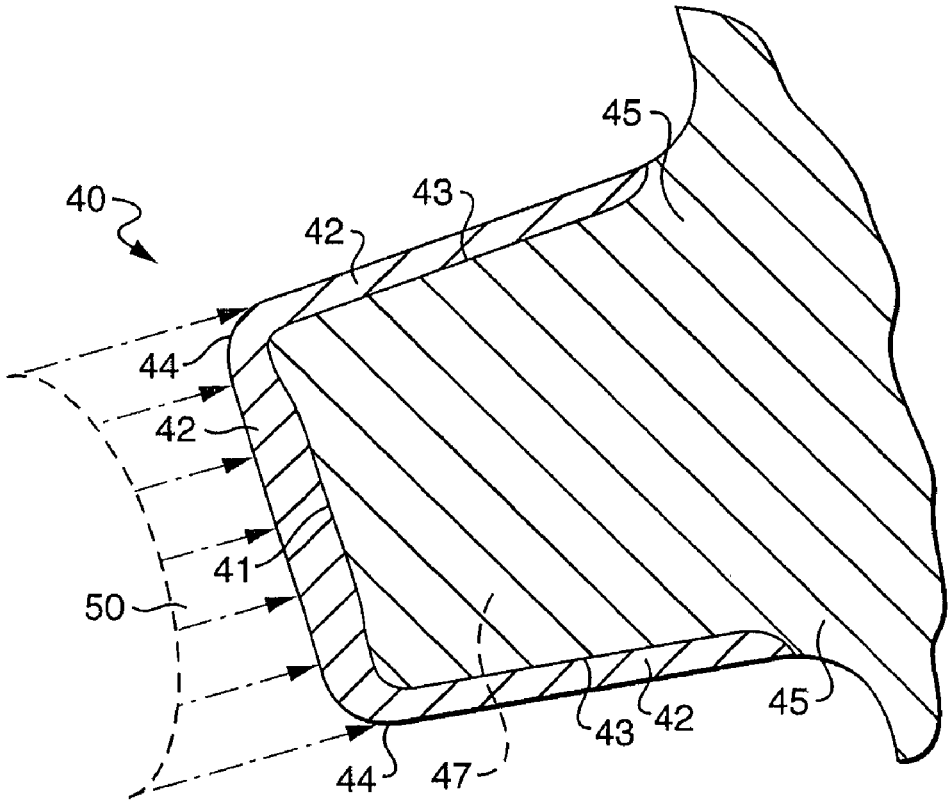
FIG. 2C (Prior Art)
FIG. 2C is a cross-sectional prior art view of a tooth illustrating the axial stress distribution, crest, and hardfacing of the tooth.

In one embodiment of the invention, as shown in FIG. 1, the teeth 20 have an axial crest 24. Axial crests 24 are so called because the crest 24 generally is substantially aligned with the axis of rotation of the cone 18 that the tooth is located on. In an alternative embodiment, the teeth 20 may have a circumferential crest (not shown). Circumferential crests (not shown) are so called because the crest (not shown) generally is substantially oriented circumferentially about the cone 18 that the tooth is located on, or substantially aligned with a circumference of the cone 18 that the tooth is located on. A circumferential crest (not shown) would have different loading properties and stress distribution than an axial crest 24 because a circumferential crest has a rolling action with the rock formation downhole where only a portion of the crest interacts with the rock formation at one time, while for an axial crest 24, substantially the entire crest penetrates the rock formation at the same time. In another embodiment of the invention (not shown), the teeth 20 have a crest 24 that is neither axial nor circumferential, but the crests 24 are substantially aligned with a line that is between the axis of rotation of the cone 18 that the tooth is located on and the circumference of the cone 18 that the tooth is located on. In another embodiment, the crests 24 are substantially aligned with a line that is within about 40° (in any direction) of the axis of rotation of the cone 18 that the tooth is located on. In another embodiment, the crests 24 are substantially aligned with a line that is within about 30° (in any direction) of the axis of rotation of the cone 18 that the tooth is located on. In another embodiment, the crests 24 are substantially aligned with a line that is within about 15° (in any direction) of the axis of rotation of the cone 18 that the tooth is located on.

Figure 7:
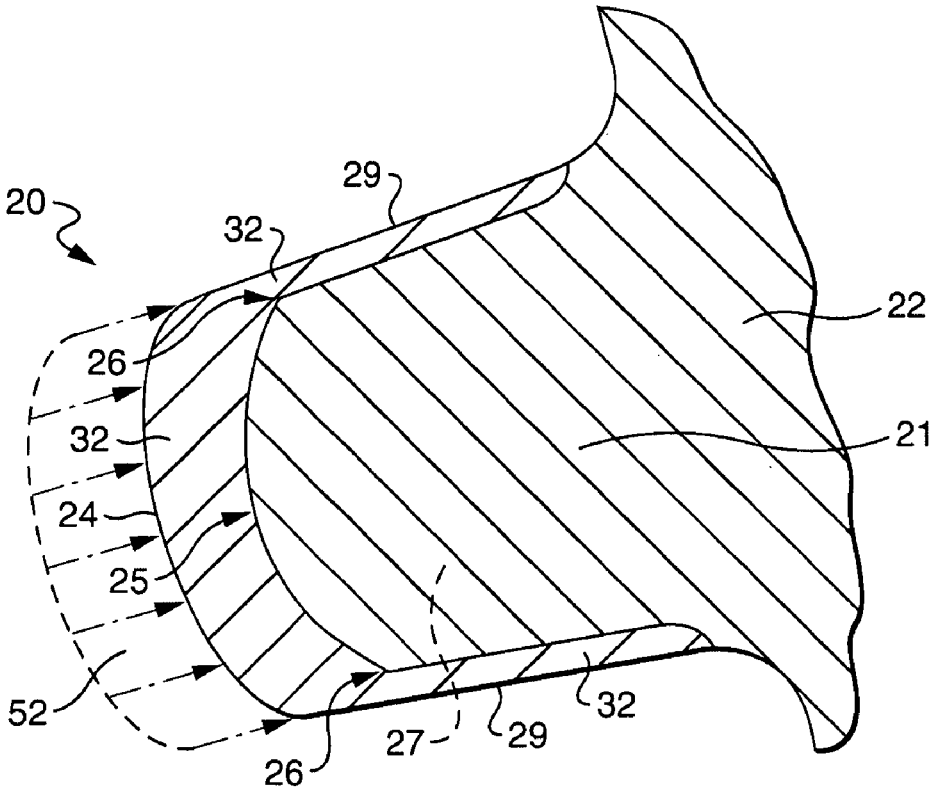
FIG. 7 is a cross-sectional view of the axial stress distribution of an improved hardfaced chisel crested milled tooth.

FIG. 7 shows an embodiment of the tooth of FIG. 3 with an axial stress distribution. The tooth (20) may have a convex axial stress distribution (52) as shown in FIG. 7. This convex axial stress distribution (52) provides a higher level of axial stress in the middle of the crest (24) than at the corners (26) of the tooth (20). Advantages of this convex axial stress distribution (52) may include aggressive penetration of the rock formation while drilling.

Figure 8:
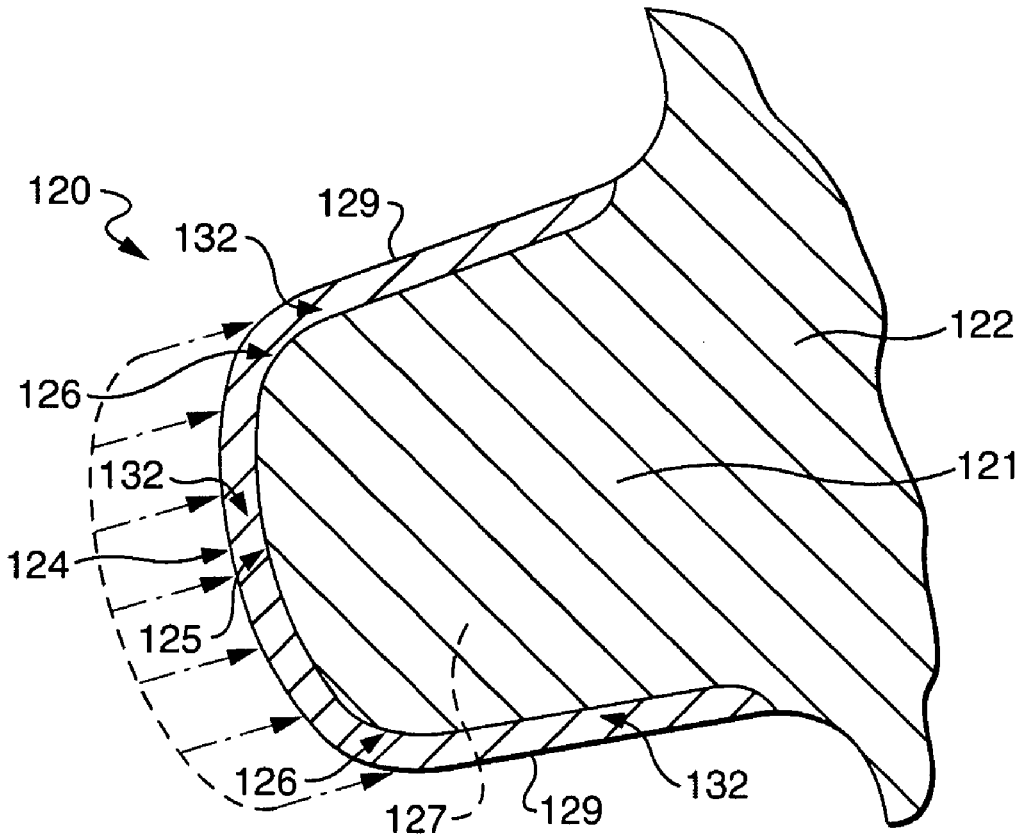
FIG. 8 is a cross-sectional view of the axial stress distribution of another configuration of an improved hardfaced milled tooth.
Figure 9:
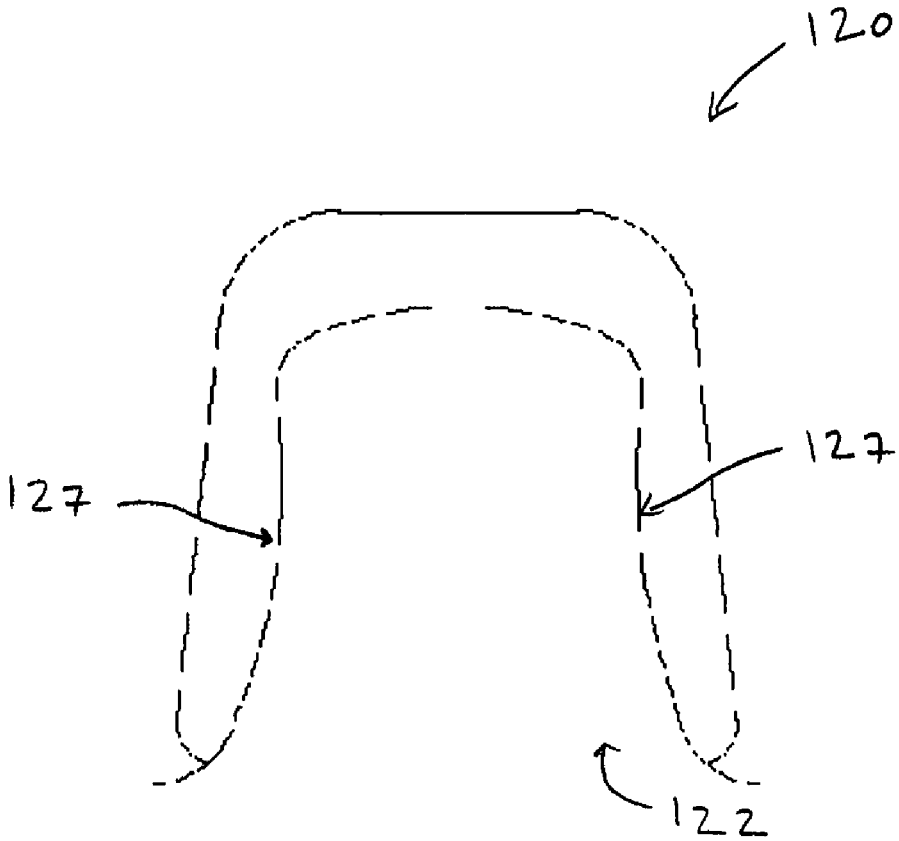
FIG. 9 is a cross-sectional view of a hardfaced milled tooth in accordance with an embodiment of the invention.
Figure 10:
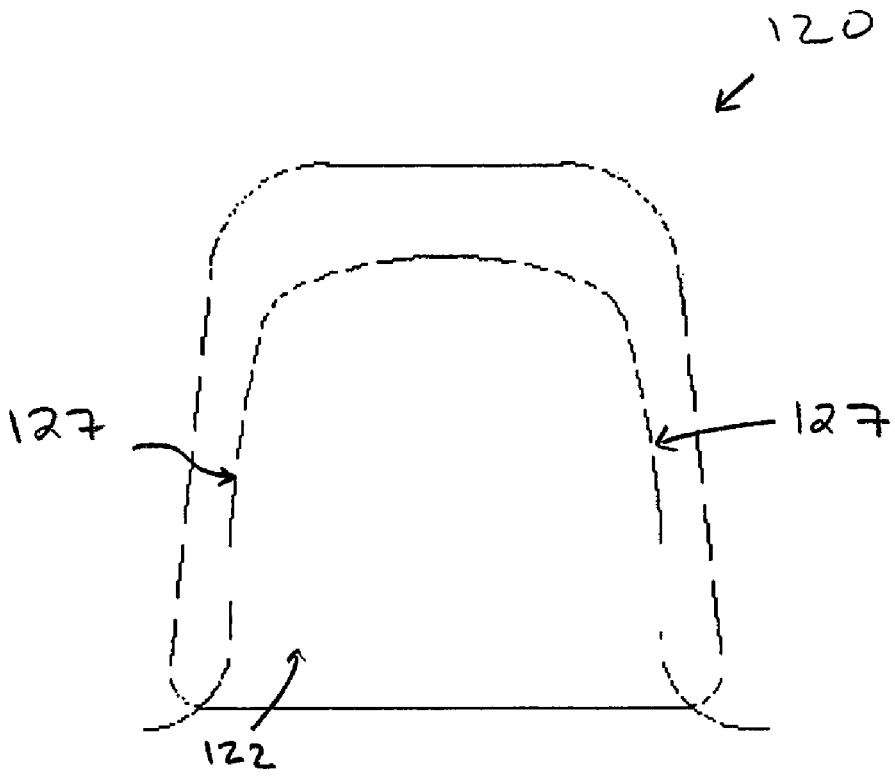
FIG. 10 is a cross-sectional view of a hardfaced milled tooth in accordance with an embodiment of the invention.
Figure 11:
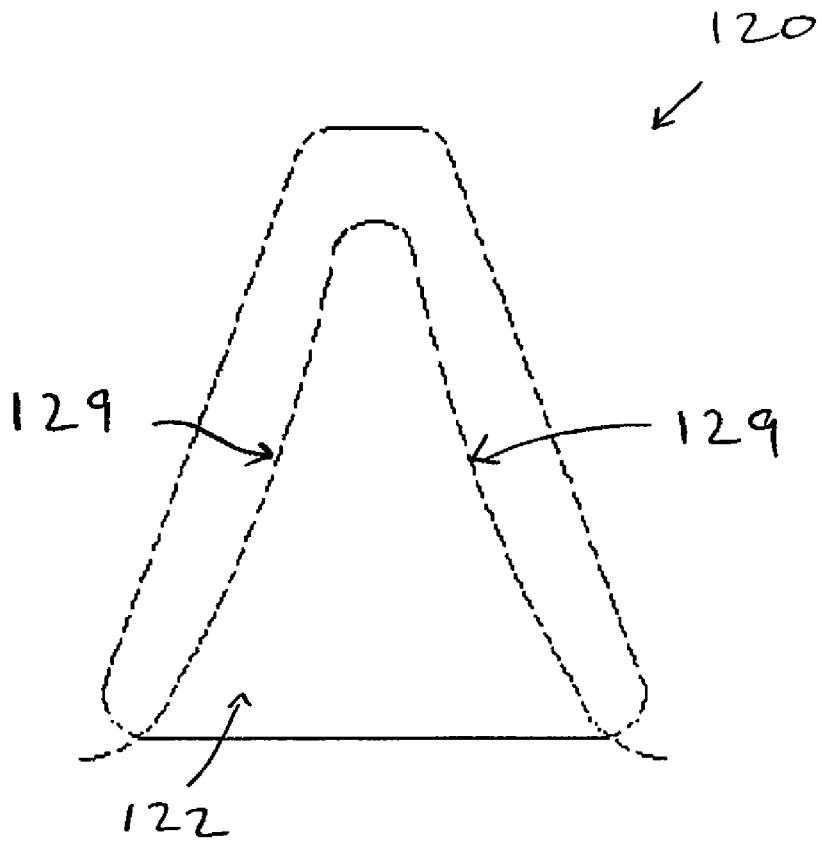
FIG. 11 is a cross-sectional view of a hardfaced milled tooth in accordance with an embodiment of the invention.
Figure 12:
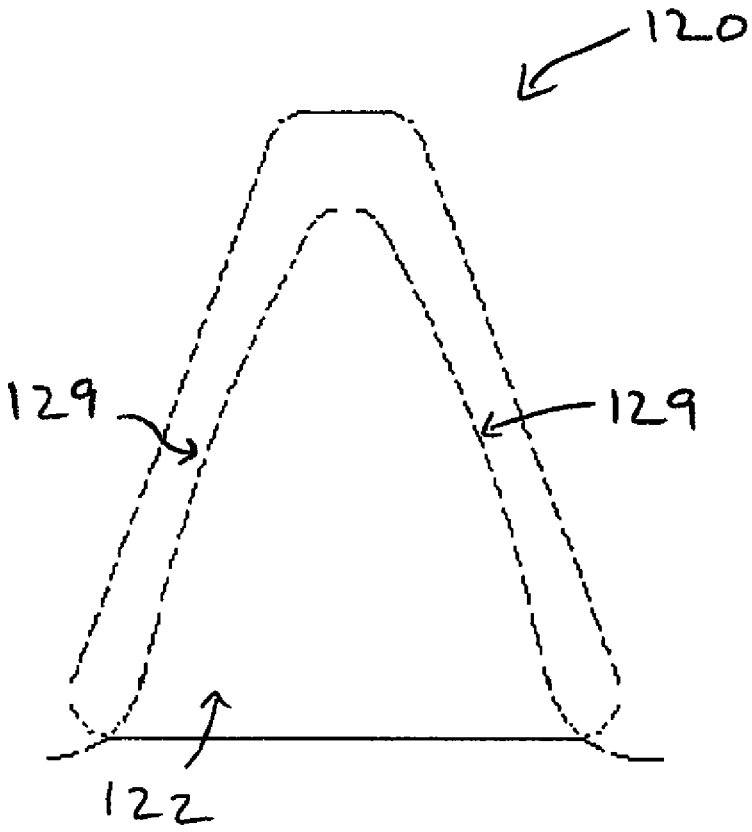
FIG. 12 is a cross-sectional view of a hardfaced milled tooth in accordance with an embodiment of the invention.

FIG. 8 shows an embodiment of the tooth of FIG. 5 with an axial stress distribution. The tooth (120) may have a level axial stress distribution (54) as shown in FIG. 8. This level axial stress distribution (54) provides a substantially even level of axial stress in the middle of the crest (124) as compared to the level of axial stress at the corners (126) of the tooth (120). Advantages of this level axial stress distribution (54) may include favorable tooth wear at the corners (126).

In one embodiment, shown in FIG. 7, the crest geometry is adapted and/or designed to produce a convex axial stress distribution. In another embodiment, shown in FIG. 8, the crest geometry is adapted and/or designed to produce a substantially even axial stress distribution. In another embodiment, the crest geometry is adapted and/or designed to gradually increase the thickness of the hardfacing on the crest in relation to the magnitude of the axial stress. In another embodiment, the crest geometry is adapted and/or designed to produce a substantially smooth axial stress distribution; some prior art crest geometries could produce concave, or erratically shaped axial stress distributions.

Other advantages of the invention may include one or more of the following:

The larger radius at the corners of a crest of a milled tooth enables a thicker layer of hardfacing at the corners of the crest of the tooth;

A thicker layer of hardfacing provided along a crest of a chisel type milled tooth between radiused corners enhances the durability of the tooth as it operates in a borehole;

The radiusing of the corners adjacent the flanks and ends of the chisel crested teeth further strengthens the capability of the tooth to retain its hardfacing during downhole operations;

A convex substrate crest and a convex hardfacing crest provides a uniform axial stress distribution across the crest;

A convex substrate crest and a flat hardfacing crest provides a gradual increase in the hardfacing thickness, and thicker hardfacing at the corners;

A convex substrate crest provides a convex axial stress distribution;

A convex substrate crest provides a substantially even axial stress distribution;

A convex substrate crest provides a substantially smooth axial stress distribution;

A convex substrate crest provides a preferred loading condition; and

A convex substrate crest provides improved wear characteristics.

Other advantages of the invention will be apparent from the appended claims.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of forming milled teeth on a roller cone of a milled tooth roller cone rock bit comprising:

shaping a crest of at least one chisel shaped milled tooth such that said crest comprises at least one convex profile from one corner to an opposite corner of said crest, wherein said convex crest is adapted to produce at least one of a convex axial stress distribution, a substantially even axial stress distribution, and a substantially smooth axial stress distribution; and radiusing each of said corners at the ends of the crest of said at least one chisel shaped milled tooth, applying a layer of hardfacing material such that a thickness of said layer is selectively greater on at least one corner than a thickness of the layer across a middle of the crest.

2. The method of claim 1, wherein said layer of hardfacing material is applied over said radiused corners.

3. The method of claim 1, further comprising:

applying said layer of hardfacing material such that a thickness of said layer of hardfacing material varies across at least a predetermined portion of said at least one chisel shaped milled tooth.

4. The method of claim 1, wherein a crest of said layer of hardfacing material is substantially flat.

5. The method of claim 1, wherein a crest of said layer of hardfacing material is convex.

6. The method of claim 1, wherein there is a single convex profile formed between said radiused ends of said crest of said at least one chisel shaped milled tooth.

7. The method of claim 1, further comprising:

shaping a flank of said at least one chisel shaped milled tooth such that said flank comprises at least one convex profile.

8. The method of claim 7, further comprising:

shaping an end of said at least one chisel shaped milled tooth such that said end comprises at least one convex profile.

9. The method of claim 7, further comprising:

shaping an end of said at least one chisel shaped milled tooth such that said end comprises at least one concave profile.

10. The method of claim 1, further comprising:

shaping a flank of said at least one chisel shaped milled tooth such that said flank comprises at least one concave profile.

11. The method of claim 10, further comprising:

shaping an end of said at least one chisel shaped milled tooth such that said end comprises at least one convex profile.

12. The method of claim 10, further comprising:

shaping an end of said at least one chisel shaped milled tooth such that said end comprises at least one concave profile.

13. The method of claim 12, further comprising:

shaping an end of said at least one chisel shaped milled tooth such that said end comprises at least one convex profile.

14. The method of claim 1, further comprising:

shaping an end of said at least one chisel shaped milled tooth such that said end comprises at least one concave profile.

15. The method of claim 1, wherein shaping said crest of said at least one chisel shaped milled tooth comprises:

substantially aligning said crest with an axis of rotation of said roller cone.

16. The method of claim 1, wherein shaping said crest of said at least one chisel shaped milled tooth comprises:

substantially aligning said crest with a line that is within 40° of an axis of rotation of said roller cone.

17. The method of claim 1, wherein shaping said crest of said at least one chisel shaped milled tooth comprises:

substantially aligning said crest with a line that is within 30° of an axis of rotation of said roller cone.

18. The method of claim 1, wherein shaping said crest of said at least one chisel shaped milled tooth comprises:

substantially aligning said crest with a line that is within 15° of an axis of rotation of said roller cone.

* * * * *